US011851866B2

(12) United States Patent
Menzies et al.

(10) Patent No.: US 11,851,866 B2
(45) Date of Patent: Dec. 26, 2023

(54) FLOOR DRAIN

(71) Applicant: MENZIES ROOFING CORPORATION, Surrey (CA)

(72) Inventors: Sam Menzies, Cloverdale (CA); Chuon Sem, Surrey (CA); Steve Schulz, Surrey (CA)

(73) Assignee: Menzies Roofing Corporation, Surrey (CA)

( * ) Notice: Subject to any disclaimer, the term of this patent is extended or adjusted under 35 U.S.C. 154(b) by 305 days.

(21) Appl. No.: 17/273,905

(22) PCT Filed: Sep. 11, 2019

(86) PCT No.: PCT/CA2019/051280
§ 371 (c)(1),
(2) Date: Mar. 5, 2021

(87) PCT Pub. No.: WO2020/051697
PCT Pub. Date: Mar. 19, 2020

(65) Prior Publication Data
US 2021/0285202 A1 Sep. 16, 2021

Related U.S. Application Data

(60) Provisional application No. 62/729,953, filed on Sep. 11, 2018.

(51) Int. Cl.
*E03F 5/04* (2006.01)
*E03F 5/14* (2006.01)
*E04D 13/04* (2006.01)

(52) U.S. Cl.
CPC ..... *E03F 5/0407* (2013.01); *E03F 5/14* (2013.01); *E04D 13/0409* (2013.01); *E04D 2013/0413* (2013.01)

(58) Field of Classification Search
CPC ..... E03F 5/0407; E03F 5/14; E04D 13/0409; E04D 2013/0413
USPC ..... 4/679, 286, 290–292
See application file for complete search history.

(56) References Cited

U.S. PATENT DOCUMENTS

| | | | | |
|---|---|---|---|---|
| 3,393,409 | A | 7/1968 | Politz | |
| 4,984,309 | A | 1/1991 | Lowry | |
| 6,330,724 | B1 | 12/2001 | Belle | |
| 2008/0295236 | A1* | 12/2008 | Eichler | E03C 1/264 4/292 |
| 2014/0131996 | A1* | 5/2014 | Murphy | E03F 5/0409 285/136.1 |

OTHER PUBLICATIONS

International Search Report and Written Opinion from corresponding International Application No. PCT/CA2019/051280 dated Dec. 12, 2019, 8 pages.

* cited by examiner

*Primary Examiner* — Tuan N Nguyen
(74) *Attorney, Agent, or Firm* — Palmer IP Inc.

(57) ABSTRACT

A floor drain and method of manufacture is described. The drain assembly includes a transverse bar in the throat of the drain base. The bar supports a substantially vertical, elongated connecting member or fastener to the strainer flush with the floor, and acts to transfer any vertical downward forces to the side wall of the drain base. The drain assembly may be milled from a single piece of metal and include an integral no hub for greater structural integrity.

16 Claims, 6 Drawing Sheets

FLOOR DRAIN

FIELD

This invention relates to plumbing and plumbing fixtures. More particularly, this invention relates to floor drains including strainers, grates and down pipes.

BACKGROUND

Objects of the present invention include providing a drain which seals effectively, is resistant to breakage of the drain base and strainer, and which is inexpensive and easy to manufacture in a minimal combination of parts.

Buildings are typically constructed with a slight camber to the floors, including decks, so that liquids flow to a low point on the floor. A drain is, therefore, typically provided at each low point. The drain often includes a strainer, grate or cap to permit the passage of liquid, but to retain debris, in order to avoid blocking the drain. It is important to create a good seal between the floor and the drain, to stop liquid ingress to the sub-floor. Force applied by objects and people to the strainer, grate or cap and the drain apparatus create movement and often, thereby, compromise the seal between the drain apparatus and the floor. Additionally, if liquid ingress commences, the liquid can freeze and lift the drain and or the grate, causing more damage. Often the strainer or grate, which is unsupported in the central portion, is fractured, cracked, or broken, due to the force applied by objects placed on it or moving across it, including people standing on it. Also, the drain assembly is often exposed to corrosive and acidic materials, causing rust and rapid deterioration of the assembly.

Accordingly, there is a need for an improved strainer and drain assembly, such that a reliable seal between the drain and floor is achieved, and when force is applied to the assembly, the force is evenly distributed, thereby both resisting breakage and maintaining an even seal. Additionally, new materials are desired to avoid the rapid corrosion.

SUMMARY

A drain system comprises a drain base defining an inner channel for providing a flow path for a fluid, such as water, to travel from a surface of a floor to downstream drainage piping, and a strainer positioned in the drain base for catching and retaining debris.

In a broad aspect of the invention, a drain system for fluidly connecting a surface of a roof to downstream plumbing, the drain system comprises a base having an open top end and an open bottom end, and at least one sidewall between the open top and open bottom ends forming an inner channel adapted to provide a fluid flow path from the open top end to the open bottom end, a drain support member disposed across the inner channel and coupled to opposing portions of the sidewall, and a strainer plate, secured to the drain support member, for retaining debris and preventing the debris from entering into the open end of the base.

In another broad aspect of the invention, a method of installing a drain assembly having a base with at least one sidewall and a strainer, the method comprising the steps of removing a portion of a floor sized sufficiently to receive the drain assembly therein, thereby creating a hole, positioning the base within the hole in the floor and securing the base to the floor, overlaying a water proofing membrane over the floor and the base, wherein a portion of the water proofing membrane is folded over and positioned within an interior of the base, clamping the water proofing membrane between the strainer and the base; and transmitting a component of a force applied to the strainer laterally and evenly distributing the force to the drain assembly.

DETAILED DESCRIPTION

Figure 1:
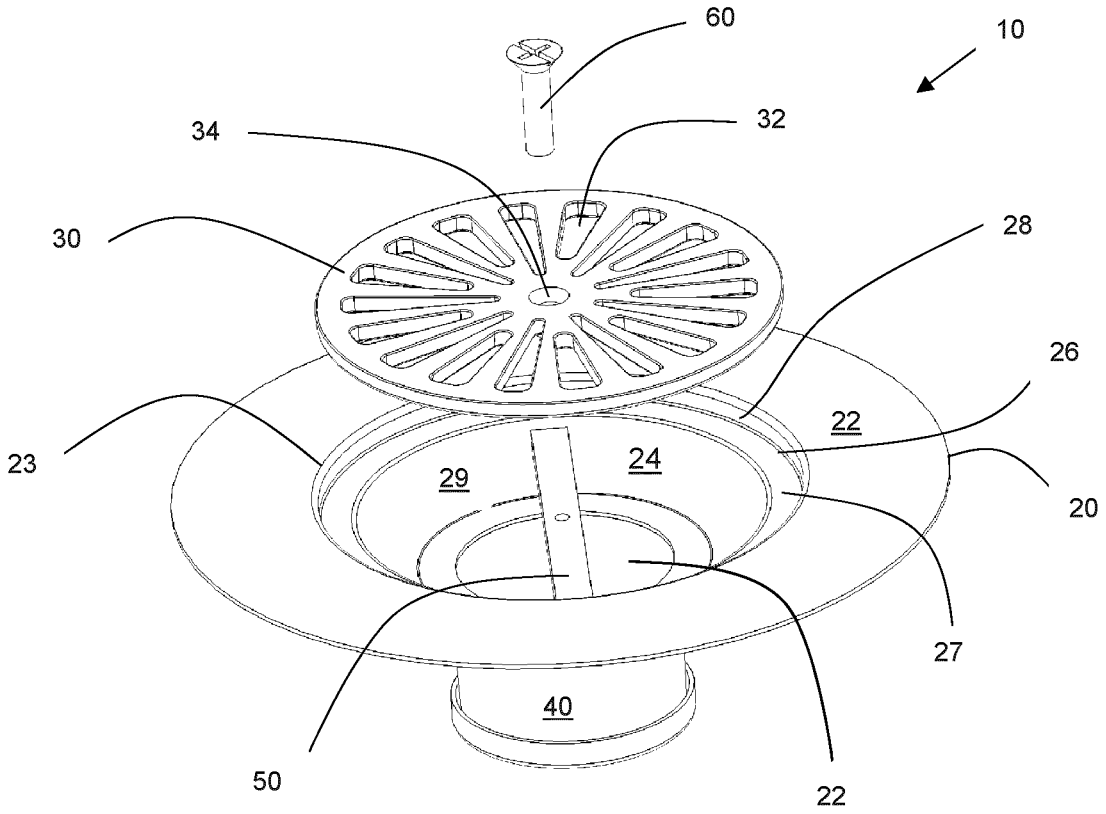
FIG. 1 is an exploded top perspective view of a floor drain assembly.

This invention is best understood with reference to the drawings. Referring to FIG. 1, an exploded top perspective view of a drain apparatus 10 is shown. A concave bowl or inverted frustroconical drain base 20 is provided, with an open top end 21, and an open bottom end 25, defining an interior of the base, or inner channel 29 therebetween. The drain base 20 has a vertical axis. The inner channel 80 is adapted to provide a fluid flow path and funnel water flow from a floor level or slightly below floor level (not shown here) through the open top end of the drain base 20 to a downpipe, drain pipe or no hub 40 structure, through the open bottom end. The top of the drain base 20 flares into a wide flange 22. The diameter of the drain base 20 reduces, ideally in a smooth transition or in a concave, decreasing radius curve in elevation view, until the bottom of the drain base 20 abuts the top of a down pipe 40, which is ideally substantially cylindrical with substantially vertical sides, and permits the downward flow of water into various sizes of pipe, as selected. The down pipe 40 is also referred to as a "no hub" in the industry. The concave drain base 20 promotes helical flow.

A standard dimension of the drain assembly is up to 12 inches diameter at the flange or top end, and 2 or 3 inches diameter at the down pipe 40 or bottom end, but these diameters may vary to meet different parameters including building codes, different liquids and fluid dynamic conditions such as the type of floor grate etc.

A drain support member 50 is disposed horizontally across the vertical axis of the drain assembly 10 approximately mid height between the top and bottom of the annular sidewall 24 of the drain base 20. The drain support member 50 may be solid, or a "V" or "U" channel, and is ideally substantially a rectangular prism, but other elongated shapes may be employed. The ends 52 of the drain support member 50 are beveled to mate with opposing portions of the curved wall 24 of the drain base 20, such that the top surface 53 of the drain support member 50 has a length greater than the bottom surface 54 of the drain support member 50. The drain support member 50 may be affixed to the sidewall 24 in any commercially known manner, including welding, milling, gluing, riveting, screwing or other method to solidly attach the beveled ends of the drain support member 50 to the curved sidewall 24.

In embodiments, the drain support member 50 can be cross-shaped or even have a more complex shape, having circumferentially evenly spaced and radially extending arms, to evenly distribute weight and redirect force applied thereon onto the drain apparatus 10.

Figure 5:
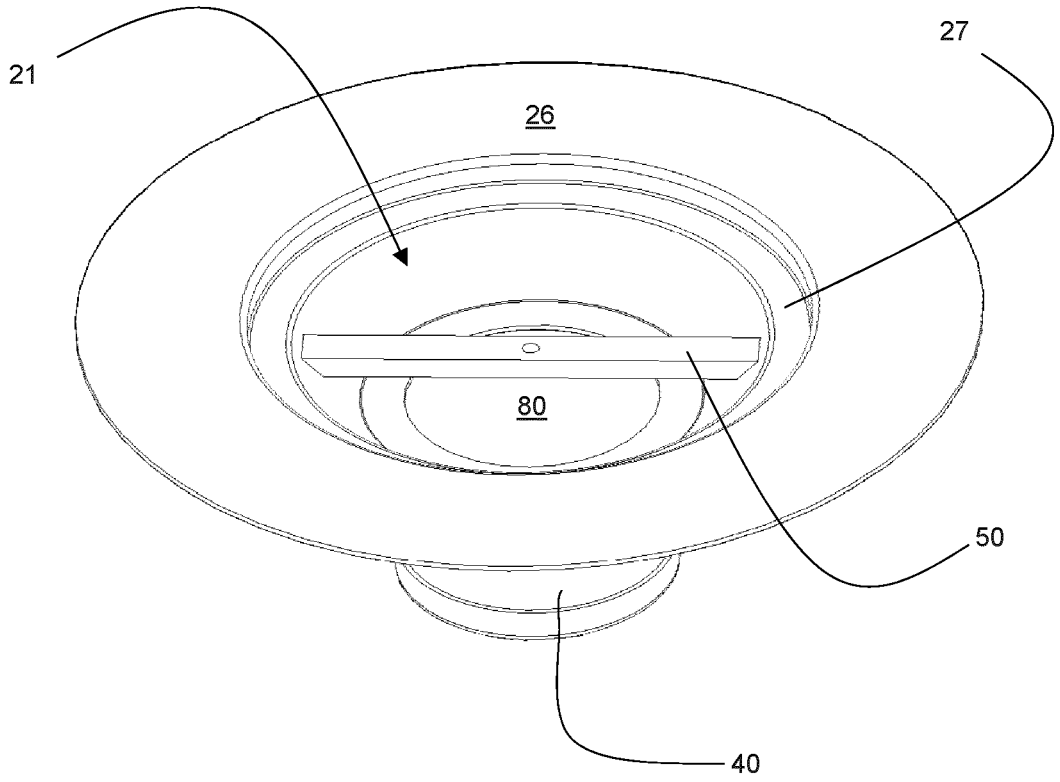
FIG. 5 is a top perspective view the with drain bar installed.

FIG. 5 also shows the drain support member 50 in a top perspective view of the drain assembly 10.

An annular collar 26 or shoulder is disposed between the sidewall 24 and the flange 22. The top edge of the sidewall 24 abuts the annular collar 26 which has a horizontally disposed flat annular portion 27 adapted to receive a strainer 30, and a substantially vertical annular wall 28 abuts the horizontal ring 27, such that the strainer 30 is largely retained within and by the vertical wall 28. The inner edge of the flange 22 has an annular raised portion or lip 23, adapted to abut flooring and or sealing material (not shown). The flange may be coated with PVC or other water-resistant material for sealing and anti-corrosion purposes. The drain assembly 10 may be comprised of copper, plastic, aluminium or other materials or a mixture thereof, but is ideally made of aluminium, due to its strength and anti-corrosive properties.

A grate or strainer 30 is disposed at the top end of the drain base 20 such that the outer edge of the underside of the strainer 30 abuts the horizontal collar 27 of the drain base 20 collar 26, and is thereby supported by the drain base 20. The strainer 30 is optimally circular, but may be generally arcuate, square, or other shapes. The strainer or grate 30 optimally has a plurality of holes 32 or cut-outs to permit the passage of fluids but to retain solids, but the strainer may also be a cap.

There is a central hole 34 in the strainer 30 to retain a removable fastener 60. The removable fastener 60 is, optimally, self tapping, with a beveled surface under the head of the screw 60 which mates with a corresponding bevel of opposite angle in the edge of the central hole 34 in the strainer 30, ie. to permit counter sinking so that fastener 60 head lies flush with the strainer 30. In an embodiment, the removable fastener 60 can be a screw made of a suitable material that is not prone to corrosion, such as stainless steel, aluminum, or galvanized steel. In a preferred embodiment, if the flange 22 is made of a material such as aluminum, then the removable fastener 60 can be made of a different material, such as stainless steel. Optimally, a fine pitch thread is used on the fastener 60, such that there is no displacement of the fastener in relation to the drain support member 50, once installed and tightened. The fastener 60 is removeably attached to the strainer 30 at its top end (at the underside of its head) and at a lower, distal end, is attached to the substantially central portion of the drain support member 50, thereby retaining the strainer 30 in place.

The strainer 30 may be of varying thicknesses, but is typically of a uniform thickness, and is optimally ¼ inch thick, in order to bear forces associated with most floor uses. In an embodiment, the strainer 30 can, preferably, have a thickness between 0.200 to 0.250 inches thick, but the thickness may be adapted to the diameter and typical loads applied (the greater the diameter of the strainer 30 and the greater the loads applied, the greater the thickness required). The strainer 30 holes 32 are, optimally, a plurality of ellipses in the shape of a corn kernel, as shown. The holes 32 may be other shapes, however, including crescents, rectangles, circles, or polygons. The elliptical shapes shown are advantageous in that they retain a strut area in the strainer 30 from the outer supported edge of the strainer 30, which rests on the horizontal collar 27 of the drain base, providing strength in the strainer 30 to resist downward forces, such as a person standing on it.

Figure 2:
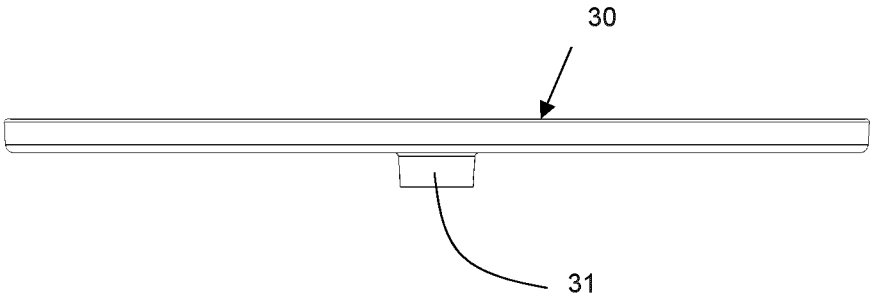
FIG. 2 is a side elevation of the strainer.

Referring now to FIG. 2, a side elevation of the strainer 30, an optional annular ring 31 or collar projecting from the underneath of the strainer 30, is shown. The ring 31 has a hole through the vertical central axis adapted to receive and reinforce the fastener 60.

Figure 3:
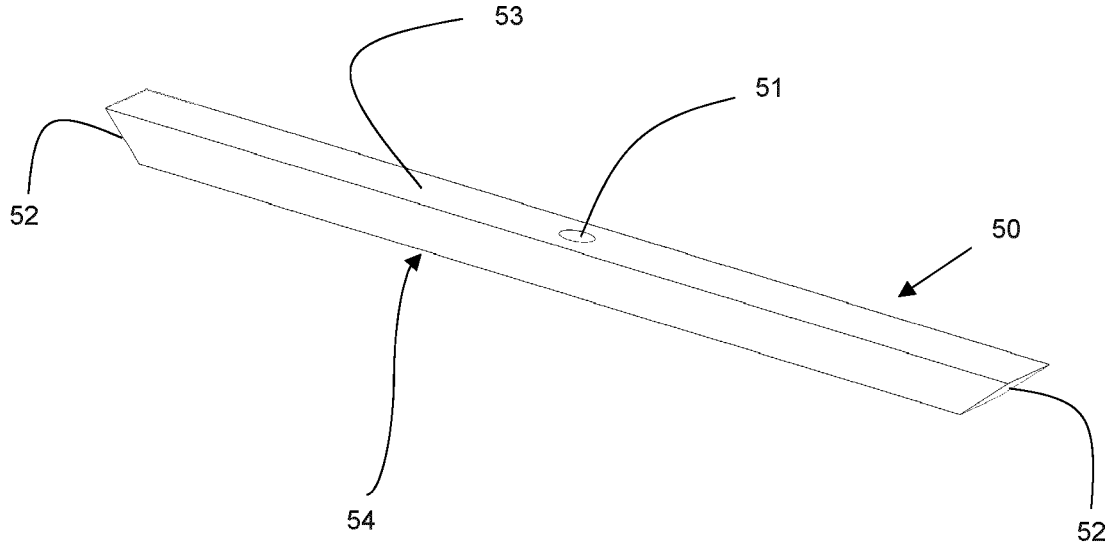
FIG. 3 is a top perspective view of the drain bar.

Referring now to FIG. 3, a top perspective view of the drain support member 50 is shown, with a central aperture 51 disposed substantially in the middle of the top surface of the member 50, adapted to receive the fastener 60 therethrough.

Figure 4:
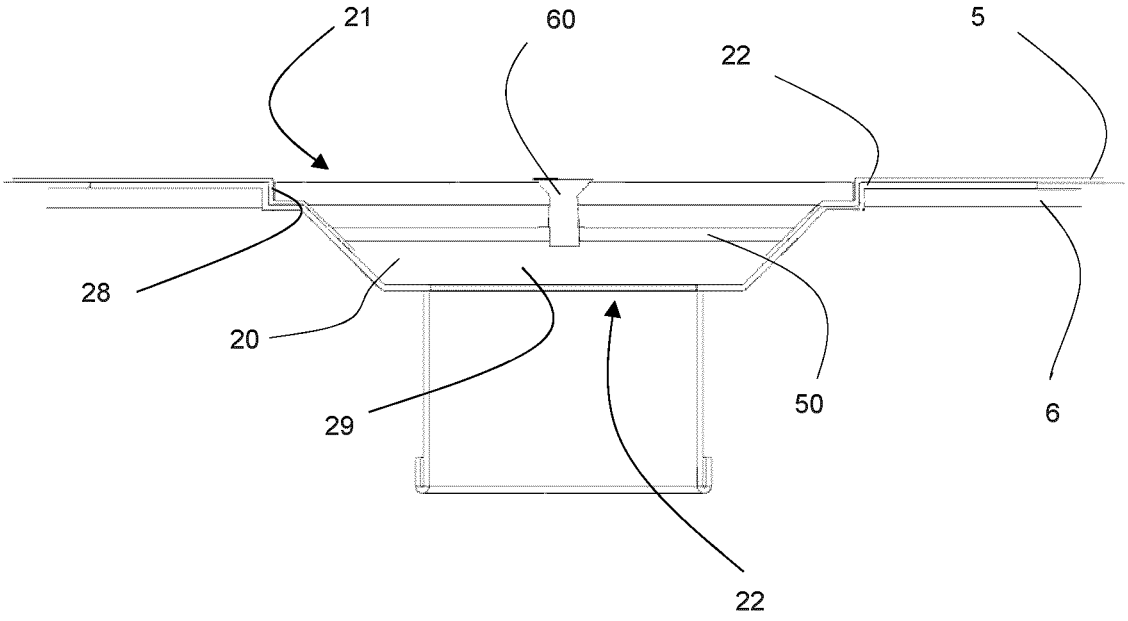
FIG. 4. is a side elevation view of the drain assembly installed.

Referring now to FIG. 4, a side elevation view of the invention installed in a floor, including a cut away portion of the floor 5, is shown. To install the drain assembly 10, a hole is cut, drilled, excavated or otherwise made in the floor 5, and sub floor 6, if applicable. The downpipe or no hub 40 is attached to a drain pipe. The no hub 40 may be integral to the drain base 20 or a separate component attached by any commercially known means. The underside of the flange or collar 22 is placed on the subfloor 6 or floor 5, as is applicable. The flooring material 5 is then affixed, by any known commercial means including gluing, such as using an adhesive, to the top surface of the flange 22, optimally so that the end edge of the floor 5 abuts the lip 23 on the flange. The strainer 30 is placed on the collar 27 of the drain base 20, and the fastener is inserted through the strainer hole 34, then into the central aperture 51, and screwed tight, such that the strainer 30 is removeably attached to the drain base 20. The flange 22 is typically slightly recessed in to the floor 5 such that once the floor 5 overlaps the flange 22, the top surface is flush with the strainer 30, or the strainer 30 may be slightly recessed.

FIG. 5 shows a top perspective view of the drain assembly 10.

Optionally, once the drain base 20 is installed, a thin membrane (i.e. water proofing material) can be laid on top of the decking and over the flange 22, with a portion of the thin membrane being folded over and positioned within a top portion of the drain base. The strainer 30 is then positioned within the drain base 20 and secured to the drain base 20 with a screw 60. The securing of the strainer 30 not only maintains the strainer 30 in position relative to the drain assembly 10, but also serves to clamp the thin membrane (not shown) between the strainer 30 and the drain base 20 therebetween. By securing the fastener 60, the drain assembly becomes a solid unit, and any downward force applied to the strainer 30 is transferred through the outer edge of the strainer 30 and the fastener 60. The force transmitted through the outer edge of the strainer 30 is transmitted downward through the collar 26 of the drain base, and any torsional force results in little or no movement of the drain assembly 10, due to its solid mounting position in the floor 5. The component of the force that is transmitted down through the fastener 60, is transmitted laterally through the drain support member 50, and through the beveled ends, then is transmitted evenly to the side wall 24 of the drain base 20, thereby transferring any force applied to the strainer 30 to the entire drain assembly 10 in distributed and even fashion, thereby avoiding breakage of the assembly 10 and in particular the strainer 30, and also avoids breaking the seal (not shown) around the flange 22.

The assembly is advantageously manufactured from a spinning die (i.e. via a metal spinning lathe or computer numerical control ("CNC") milling). Copper is often used and may be used with the present invention, but copper is only a useful material if it oxides to the point that a patina covers the exposed surfaces. Aluminium is an optimal material for the present invention, but other materials such as copper, plastic and steel, ideally galvanized or stainless may be used. In an optimal embodiment, the drain base 20 and the down pipe or no hub 40 are spun or milled from a single piece of metal, thereby providing a strong structural unit, which resists any turning, bending and torsional forces, thereby maintaining a good seal with the floor 5 and avoiding breakage of the strainer 30.

Figure 6:
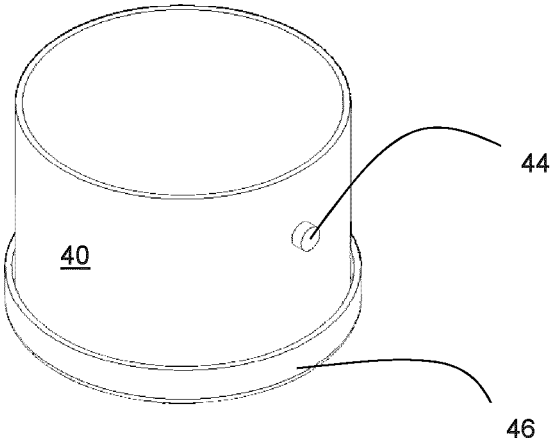
FIG. 6 is a top perspective view of the no hub.

Referring now to FIG. 6, a top perspective view of the no hub 40, is shown. The no hub 40 may also include a stop peg 44 to stop the drain base 20 from mounting too low. The no hub 40 may also include raised lip on the bottom portion for connection to a down pipe (not shown).

Optionally, the drain base 20 may also be provided without the no hub 40, particularly where the installer wishes to retrofit the drain base 20 onto existing down pipes 40. Additionally, the drain assembly 10 components may be provided in a kit and retrofitted to existing drainage systems. For instance, a drain support member 50 may be welded into an existing drain base 20, and a strainer fitted to the top portion of the drain base 20 and affixed to the drain support member 50, rendering the drain assembly 10 more stable and resistant to forces applied to the strainer 30.

The illustrative embodiments herein described are not intended to be exhaustive or to limit the scope of the claimed concepts to the precise forms disclosed. They are chosen and described to explain the principles of the concepts and their application and practical use. Many alterations and modifications are possible in the practice of this invention without departing from the scope of the concept, which is defined by the claims appended hereto.

The invention claimed is:

1. A drain system for fluidly connecting a surface to downstream plumbing, the drain system comprising:

a base having an open top end and an open bottom end spaced apart in a vertical direction, and at least one sidewall between the open top end and the open bottom end forming an inner channel adapted to provide a fluid flow path from the open top end to the open bottom end, the sidewall having at least a portion angled relative to the vertical direction;

a drain support member comprising opposed beveled ends angled to mate in a complementary manner and couple with angled portions of the sidewall of the base, disposed across the inner channel; and a strainer, secured to the drain support member, for retaining debris and preventing the debris from entering into the open top end of the base.

2. The drain system of claim 1, further comprising a fastener for securing the strainer to the drain support member.

3. The drain system of claim 2, wherein the beveled ends of the drain support member are adapted to transmit a force applied to the strainer, laterally through the drain support member to the sidewall of the base.

4. The drain system of claim 2, wherein the drain support member defines a central aperture for permitting the fastener to extend therethrough for securing the strainer to the drain support member.

5. The drain system of claim 2, wherein the strainer defines a central hole for accepting the fastener therethrough for securing the strainer to the drain support member.

6. The drain system of claim 5, wherein the strainer further comprises an annular ring on an underside thereof and in alignment with the central hole for accepting the fastener therethrough.

7. The drain system of claim 2, wherein the base is milled from a single piece of metal.

8. The drain system of claim 1, wherein the open top end flares into a flange for securing the drain system to the surface.

9. The drain system of claim 1, wherein a diameter of the base decreases in radial size when travelling from the open top end to the open bottom end creating said angled sidewall portion.

10. The drain system of claim 1, wherein the base further comprises an annular collar and a sidewall for receiving the strainer therebetween, wherein the strainer is located in the collar and the strainer is substantially flush with the surface.

11. The drain system of claim 10, wherein the annular collar further comprises a flat annular portion and a vertical annular wall.

12. A method of installing a drain assembly in a hole of a drainage surface, the drain assembly having a base with at least one sidewall, a drain support member, and a strainer, the method comprising:

positioning the base within the hole in the drainage surface and securing the base to the drainage surface; and positioning the drain support member comprising opposed beveled ends within the interior of the base to mate in a complementary manner and couple the at least one sidewall to the beveled ends, coupling the strainer to the drain support member such that the strainer is substantially flush with the drainage surface, the drain support member adapted to transmit a component of a force applied to the strainer laterally and further adapted to evenly distribute force to the at least one sidewall.

13. The method of claim 12, wherein overlaying the water proofing membrane over the surface and the base further comprises overlaying the water proofing membrane over the surface and a flange of the base.

14. The method of claim 12, wherein clamping the water proofing membrane between the strainer and the base further comprises fastening the strainer to the base using a fastener.

15. The method of claim 12, further comprising securing the drain assembly to a pre-existing drain pipe.

16. The method of claim 12, further comprising:

overlaying a water proofing membrane over the drainage surface and the base, wherein a portion of the water proofing membrane is folded over and positioned within an interior of the base; and clamping the water proofing membrane between the strainer and the base.

* * * * *